United States Patent [19]

Ono

[11] Patent Number: 4,669,120

[45] Date of Patent: May 26, 1987

[54] LOW BIT-RATE SPEECH CODING WITH DECISION OF A LOCATION OF EACH EXCITING PULSE OF A TRAIN CONCURRENTLY WITH OPTIMUM AMPLITUDES OF PULSES

[75] Inventor: Shigeru Ono, Tokyo, Japan

[73] Assignee: NEC Corporation, Tokyo, Japan

[21] Appl. No.: 626,949

[22] Filed: Jul. 2, 1984

[30] Foreign Application Priority Data

Jul. 8, 1983 [JP] Japan ..... 58-124479
Aug. 18, 1983 [JP] Japan ..... 58-150783

[51] Int. Cl.[4] ..... G10L 5/00
[52] U.S. Cl. ..... 381/40
[58] Field of Search ..... 381/29–40; 364/513, 513.5

[56] References Cited

U.S. PATENT DOCUMENTS 4,472,832 9/1984 Atal et al. ..... 381/40
4,516,259 5/1985 Yato ..... 381/36

*Primary Examiner*—E. S. Matt Kemeny
*Attorney, Agent, or Firm*—Sughrue, Mion, Zinn, Macpeak & Seas

[57] ABSTRACT

An improved excitation signal in a low bit-rate coding device for coding a discrete speech signal sequence into an output code sequence for use in exciting a synthesizing filter, an autocorrelation function of an impulse response calculated for the synthesizing filter by using a parmeter sequence representative of a spectral envelope of the segment and a cross-correlation function between the segment and the impulse response are used to produce a sequence of excitation pulses by successively deciding locations and amplitudes of the pulses with the location of a currently processed pulse decided by the use of the locations and the amplitudes of previously processed pulses and with renewal of the previously processed pulse amplitudes carried out concurrently with decision of the currently processed pulse amplitude by the use of the previously and currently processed pulse locations. Alternatively, the currently processed pulse location and the previously and currently processed pulse amplitudes are decided by the use of the previously processed pulse locations. The parameter and the excitation pulse sequences are coded and then combined into the output code sequence. The correlation functions are preferably calculated with the segment and the impulse response weighted by weights dependent on the parameter sequence. The segment may be a frame of the speech signal sequence or a subframe of a constant or variable length.

8 Claims, 11 Drawing Figures

FIG. 1
PRIOR ART
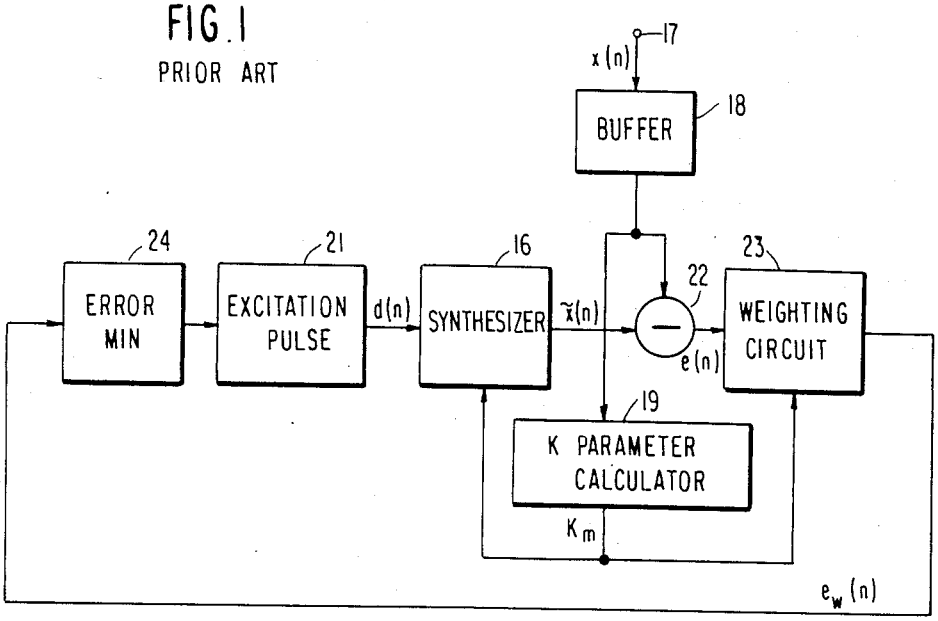
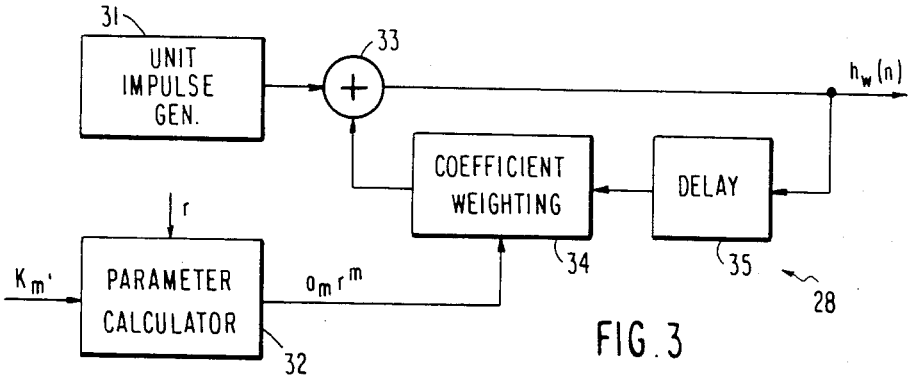
FIG. 3
FIG. 4
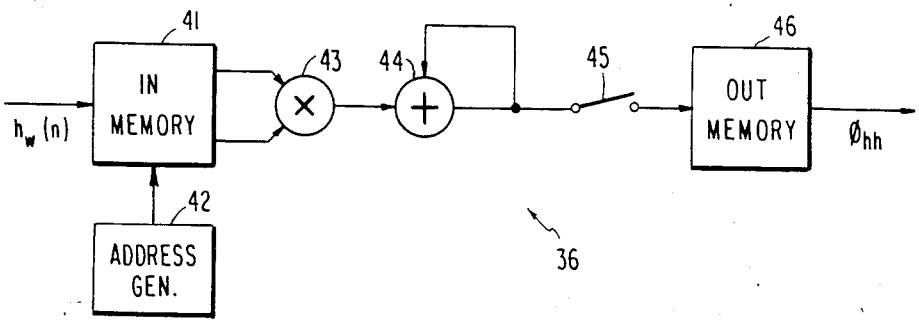

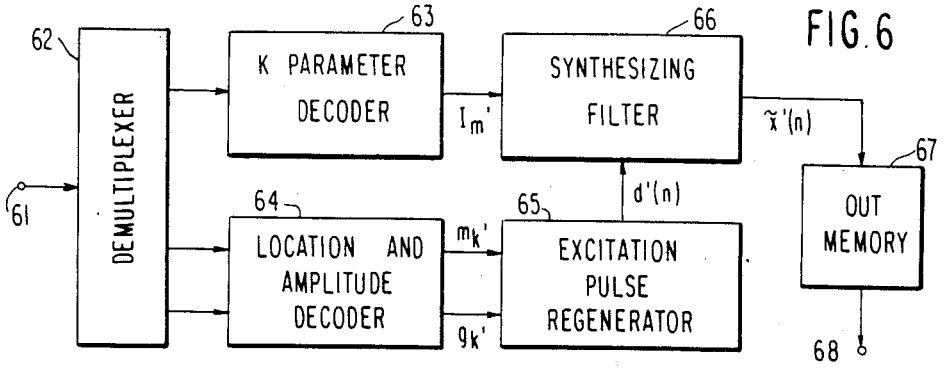
FIG. 6
FIG. 7 PRIOR ART
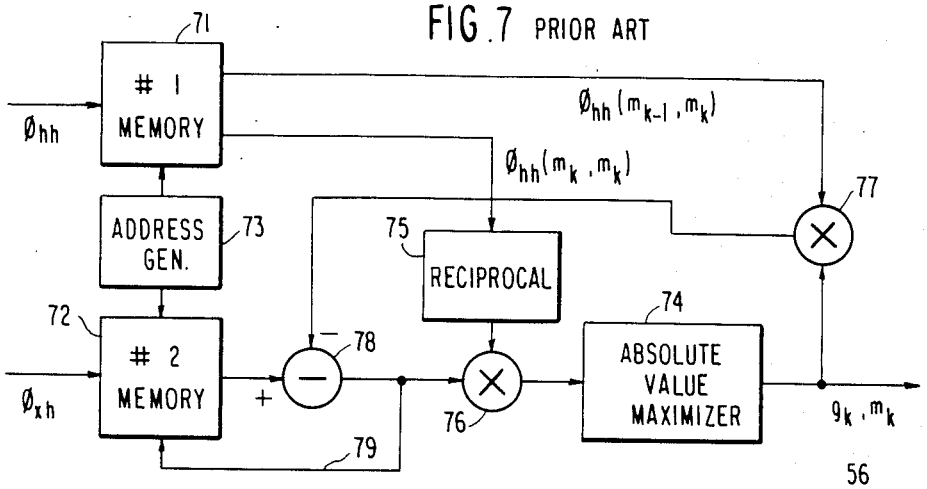
FIG. 8
PRIOR ART
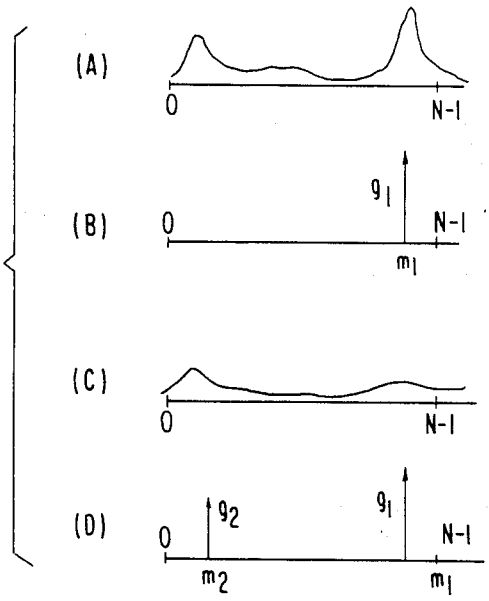

LOW BIT-RATE SPEECH CODING WITH DECISION OF A LOCATION OF EACH EXCITING PULSE OF A TRAIN CONCURRENTLY WITH OPTIMUM AMPLITUDES OF PULSES

BACKGROUND OF THE INVENTION

This invention relates to a low bit-rate speech coding method and a device therefor. The low bit-rate speech coding method or technique is for coding an original speech signal into an output code sequence of an information transmission rate of less than 16 Kbit/sec. The output code sequence is either for transmission through a transmission channel or for storage in a storing medium. The output code sequence is decoded by a decoder where the original speech signal is reproduced by synthesis. The speech coding method is useful in, among others, mobile radio communication, speech synthesis, and voice mail.

Speech coding based on a multi-pulse excitation method is proposed as a low bit-rate speech coding method in an article contributed by Bishnu S. Atal et al of Bell Laboratories to Proc. ICASSP, 1982, pages 614–617, under the title of "A New Model of LPC Excitation for Producing Natural-sounding Speech at Low Bit Rates". As will later be described more in detail with reference to one of more than ten figures of the accompanying drawing, speech synthesis is carried out according to the Atal et al article by exciting a linear predictive coding (LPC) synthesizer by a sequence or train of excitation or exciting pulses. Locations or positions and amplitudes of the excitation pulses are decided by the so-called analysis-by-synthesis (A-b-S) method It is believed that the method of Atal et al is prosperous as a method of coding speech signals at a bit rate between about 8 and 16 Kbit/sec. The method, however, requires a large amount of calculation in determining the locations and the amplitudes.

An improved "voice coding system" is disclosed in U.S. patent application Ser. No. 565,804 filed Dec. 27, 1983, by Kazunori Ozawa et al, assignors to the present assignee (Canadian Patent Application No. 444,239 filed Dec. 23, 1983). The specification of the Ozawa et al patent application will hereinafter be referred to as an elder or prior patent application. The voice or speech coding system of the elder patent application is for coding a discrete speech signal sequence into an output code sequence, which is for use in exciting a synthesizing filter in a decoder. The discrete speech signal sequence is divisible into segments, such as frames of the discrete speech signal sequence.

As will later be described more in detail, the system of the elder patent application comprises a K parameter calculator responsive to each segment of the discrete speech signal sequence for calculating a parameter sequence representative of a spectral envelope of the segment, an impulse response calculator responsive to the parameter sequence for calculating an impulse response which the synthesizing filter has for the segment, an autocorrelator responsive to the impulse response sequence for calculating an autocorrelation function of the impulse response sequence, a cross-correlator responsive to the segment and the impulse response sequence for calculating a cross-correlation function between the segment and the impulse response sequence, an excitation pulse sequence producing circuit responsive to the autocorrelation and the cross-correlation functions for producing a sequence of excitation pulses by successively deciding locations and amplitudes of the excitation pulses, a first coder for coding the parameter sequence into a parameter code sequence, a second coder for coding the excitation pulse sequence into an excitation pulse code sequence, and a multiplexer for combining the parameter code and the excitation pulse code sequences into the output code sequence.

With the system of the elder patent application, locations of the respective excitation pulses and amplitudes thereof are decided with a drastically reduced amount of calculation. It is to be noted in this connection that the locations and the amplitudes are calculated assuming that the amplitudes are dependent solely on the respective locations. The assumption is, however, not generally applicable to actual original speech signals, from each of which the discrete speech signal sequence is produced.

SUMMARY OF THE INVENTION

It is therefore an object of the present invention to provide a method of coding an original speech signal into an output code sequence of an information transmission rate of about 10 Kbit/sec or less with a small amount of calculation and yet with the output code sequence made to faithfully represent the original speech signal.

It is another object of this invention to provide a device for coding an original speech signal into an output code sequence at an information transmission rate of about 10 Kbit/sec or less with a small amount of calculation and yet with the output code sequence made to faithfully represent the original speech signal.

According to a first aspect of this invention, there is provided a method of coding each segment of a discrete speech signal sequence into an output code sequence, comprising the steps of: calculating a parameter sequence representative of a spectral envelope of the segment; coding the parameter sequence into a parameter code sequence; calculating an impulse response sequence of the synthesizing filter for the segment by using the parameter code sequence; calculating an autocorrelation function of the impulse response sequence; calculating a cross-correlation function between the segment and the impulse response sequence; producing a sequence of excitation pulses by using the autocorrelation and the cross-correlation functions in successively deciding locations and amplitudes of the excitation pulses with the location of a currently processed pulse of the excitation pulses decided by the use of locations and the amplitudes of previously processed pulses of the excitation pulses and with renewal of the amplitudes of the previously processed pulses carried out concurrently with decision of the amplitude of the currently processed pulse by the use of the locations of the previously and the currently processed pulses; coding the sequence of excitation pulses into an excitation pulse code sequence; and combining the parameter code and the excitation pulse code sequences into the output code sequence.

According to a second aspect of this invention, there is provided a method of coding each segment of a discrete speech signal sequence into an output code sequence, comprising the steps of: calculating a parameter sequence representative of a spectral envelope of the segment; coding the parameter sequence into a parameter code sequence; calculating an impulse response sequence of the synthesizing filter for the segment by using the parameter code sequence; calculating an autocorrelation function of the impulse response sequence; calculating a cross-correlation function between the segment and the impulse response sequence; producing a sequence of excitation pulses by using the autocorrelation and the cross-correlation functions in successively deciding locations and amplitudes of the excitation pulses with the location of a currently processed pulse of the excitation pulses and the amplitudes of previously processed pulses of the excitation pulses and of the currently processed pulse decided by the use of the locations of the previously processed pulses; coding the sequence of excitation pulses into an excitation pulse code sequence; and combining the parameter code and the excitation pulse code sequences into the output code sequence.

According to other aspects of this invention, there are provided a device for carrying out the method according to the first aspect of this invention and another device for carrying out the method of the second aspect of this invention.

BRIEF DESCRIPTION OF THE DRAWING

FIG. 1 is a block diagram of a conventional low bit-rate speech coding device;

FIG. 3, drawn below FIG. 1, is a block diagram of an impulse response calculator for use in the device illustrated in FIG. 2;

FIG. 4 is a block diagram of an autocorrelator for use in the device depicted in FIG. 2;

FIG. 6 is a block diagram of a decoder for use in combination with the device illustrated in FIG. 2;

FIG. 7 is a block diagram of an exciting pulse sequence producing circuit for use in a device which is of the type shown in FIG. 2 and is described in a prior patent application;

FIGS. 8 (A) through (D) are diagrams for use in describing operation of the circuit depicted in FIG. 7;

DESCRIPTION OF THE PREFERRED EMBODIMENTS

Figure 2:
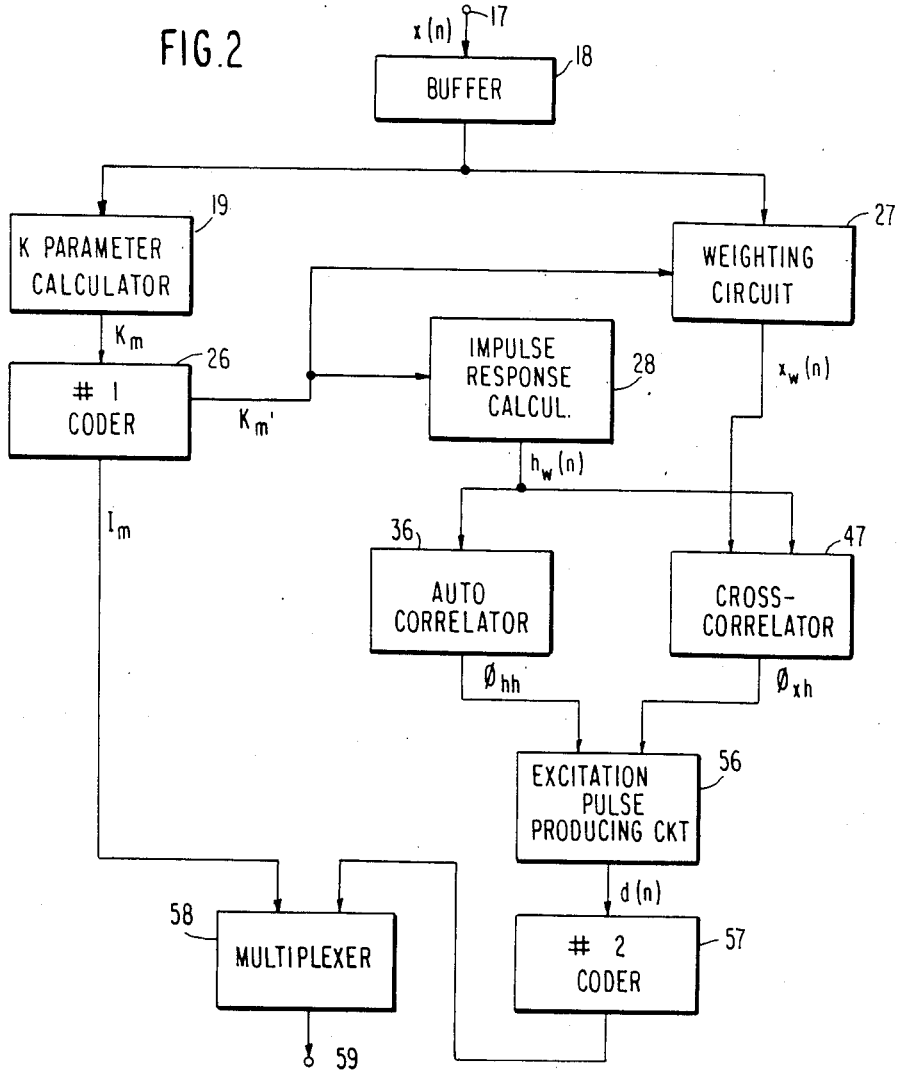
FIG. 2 is a block diagram of a low bit-rate speech coding device according to a first embodiment of the instant invention.

Referring to FIG. 1, a model proposed in the abovementioned Atal et al article will briefly be described at first in order to facilitate an understanding of the present invention. The model comprises a linear predictive coding synthesizer 16 and an excitation pulse sequence producing circuit which is for producing a sequence of excitation pulses for use in exciting the synthesizer 16 as will be described in the following.

A coder input terminal 17 is supplied with a discrete speech signal sequence x(n), which is produced by sampling an original speech signal at a sampling frequency of, for example, 8 KHz into speech signal samples and subjecting the samples to analog-to-digital conversion. A buffer memory 18 is for storing each frame of the discrete speech signal sequence x(n). The frame may be called a segment as will become clear later in the description and has a segment length of, for example, 20 milliseconds. It will be assumed that each segment consists of zeroth through (N−1)-th speech signal samples, where N is equal to one hundred and sixty under the circumstances.

The segment is delivered from the buffer memory 18 to a K parameter calculator 19 which is for calculating a sequence of K parameters representative of a spectral envelope of the segment and for feeding the K parameter sequence to the synthesizer 16. The K parameters are called reflection coefficients in the Atal et al article and will herein be denoted by $K_m$ where m represents a natural number between 1 and the order M of the synthesizer 16, both inclusive. The order M is typically equal to sixteen. The K parameter sequence will be designated by the symbol $K_m$ for the K parameters.

As will presently become clear, an excitation pulse sequence generating circuit 21 generates a sequence of excitation pulses d(n). The number of excitation pulses generated for each segment of the discrete speech signal sequence x(n), is equal to or less than a predetermined positive integer K, which may be eight or sixteen. Merely for brevity of description, it will be assumed for the time being that first, . . . , k-th, . . . , and K-th excitation pulses are generated for each segment. It is to be noted in this connection that the first through the K-th excitation pulses are not necessarily located or situated in this order along zeroth through (N−1)-th sampling instants for the zeroth through the (N−1)-th speech signal samples. A combination of the K parameter sequence $K_m$ and the excitation pulse sequence d(n) is delivered as an output code sequence to a coder output terminal which is not depicted in FIG. 1.

Supplied with the K parameter sequence $K_m$ and the excitation pulse sequence d(n), the synthesizer 16 produces a sequence of synthesized samples $\tilde{x}(n)$, which are substantially identical with the respective speech signal samples. More particularly, the synthesizer 16 converts the K parameters $K_m$ into prediction parameters $a_m$ and calculates the synthesized samples $\tilde{x}(n)$ in accordance with:

$$\tilde{x}(n) = d(n) + \sum_{m=1}^{M} a_m \tilde{x}(n-m). \quad (1)$$

A substractor 22 is for subtracting the synthesized sample sequence $\tilde{x}(n)$ from the discrete speech signal sequence x(n) to produce a sequence of errors e(n). A weighting circuit 23 is supplied with the K parameter sequence $K_m$ to weight the error sequence e(n) by weights w(n) which are dependent on the frequency characteristics of the synthesizer 16 as will shortly be described. The weighting circuit 23 produces a sequence of weighted errors $e_w(n)$ according to:

$$e_w(n) = w(n) * e(n),$$

where the symbol $*$ represents the convolution.

When the z-transform of the weights w(n) is represented by W(z), the z-transform is given by:

$$W(z) = \left(1 - \sum_{m=1}^{M} a_m z^{-m}\right) / \left(1 - \sum_{m=1}^{M} a_m r^m z^{-m}\right), \quad (2)$$

where r represents a constant which has a value preselected between 0 and 1, both inclusive, and determines the frequency characteristics of the z-transform W(z) as will be exemplified in the following.

By way of example, let the constant r be equal to unity. The z-transform W(z) is identically equal to unity and has a flat frequency characteristic. When the constant r is equal to zero, the z-transform W(z) gives an inverse of the frequency characteristics of the synthesizer 16. As discussed in detail in the Atal et al article, the choice of a value for the constant r is not critical. For the sampling frequency of 8 kHz, 0.8 may typically be selected for the constant r.

The weighted error sequence $e_w(n)$ is delivered to an error minimizing circuit 24, which stores the weighted errors $e_w(n)$ for each segment and calculates the power of the stored weighted errors as an error power J. The error power J is given by:

$$J = \sum_{n=0}^{N-1} [e_w(n)]^2,$$

and is fed back to the synthesizer 16. Locations and amplitudes of the excitation pulses d(n) are determined so as to minimize the error power J. According to the analysis-by-synthesis method, the locations and the amplitudes are determined through a loop comprising a generator for the excitation pulses, calculator of the error power J, and a circuit for adjusting the locations and the amplitudes so as to minimize the error power J. The analysis-by-synthesis method therefore requires a large amount of calculation.

The basic principles of a method and a device according to this invention are not much different from the principles described in the elder patent application. The principle of the elder patent application will be described in the following for each segment of a discrete speech signal sequence x(n). As described heretobefore, the segment consists of the zeroth through the (N−1)-th speech signal samples which are equally spaced along a time axis at the zeroth through the (N−1)-th sampling instants 0, . . . , n, . . . , and (N−1).

The sequence of the first through the K-th excitation pulses d(n) of the type described hereinabove, in represented as follows for the segment by using the Kronecker's delta:

$$d(n) = \sum_{k=1}^{K} g_k \delta(n, m_k),$$

where $m_k$ and $g_k$ represent a location and an amplitude of the k-th excitation pulse. The synthesized sample sequence $\tilde{x}(n)$ is perfunctorily given by Equation (1) also in this event.

It is possible from the definition to represent the error power J by:

$$J = \sum_{n=0}^{N-1} [(x(n) - \tilde{x}(n)) \ast w(n)]^2,$$

and furthermore by:

$$J = \frac{1}{2\pi} \oint |X(z)W(z) - \tilde{X}(n)W(z)|^2 \, dz, \quad (3)$$

where X(z) and $X(\tilde{z})$ represent the z-transforms of the discrete speech signal sequence x(n) and of the synthesized sample sequence $\tilde{x}(n)$. On the other hand, the z-transform $\tilde{X}(z)$ is given from Equation (1) by:

$$X(z) = H(z)D(z), \quad (4)$$

where H(z) represents the z-transform of a synthesizing filter, such as the linear predictive coding synthesizer 16 (FIG. 1), for the segment and is given by:

$$H(z) = 1/\left(1 + \sum_{m=1}^{M} a_m z^{-m}\right),$$

and where D(z) represents the z-transform of the excitation pulse sequence d(n). By substituting Equation (4) into Equation (3):

$$J = \frac{1}{2\pi} \oint |X(z)W(z) - H(z)W(z)D(z)|^2 \, dz. \quad (5)$$

The inverse z-transforms of the z-transforms [X(z)W(z)] and [H(z)W(z)] will be written by $x_w(n)$ and $h_w(n)$ and will be called a weighted segment and a weighted response sequence. In other words:

$$x_w(n) = x(n) * w(n),$$

and $$h_w(n) = h(n) * w(n)$$

where h(n) represents an impulse response which the synthesizing filter has for the segment. It is possible to understand that the weighted response sequence $h_w(n)$ represents an impulse response which a cascade connection of the synthesizing filter and the weighting circuit or filter has for the segment. Equation (5) is rewritten into:

$$J = \sum_{n=0}^{N-1} \left[ x_w(n) - \sum_{k=1}^{K} g_k h_w(n - m_k) \right]^2. \quad (6)$$

As described before in conjunction with the Atal et al model, the locations $m_k$ (or $m_k$'s) and the amplitudes $g_k$ (or $g_k$'s) of the first through the k-th excitation pulses should be decided so as to minimize the error power J. Equation (6) is therefore partially differentiated by the amplitudes $g_k$ (k being 1 through K) to provide partial derivatives.

When the partial derivatives are put equal to zero, the following equations result:

$$\phi_{xh}(m_k) = \sum_{i=1}^{k} g_i \phi_{hh}(m_i, m_k), \quad (7)$$

where $\phi_{hh}(m_i, m_k)$ and $\phi_{xh}(m_k)$ represent an autocorrelation or covariance function of the weighted response sequence $h_w(n)$ and a cross-correlation function between the weighted segment $x_w(n)$ and the weighted response sequence $h_w(n)$. More specifically:

$$\phi_{hh}(m_i, m_j) = \sum_{n=0}^{N-|m_i-m_j|+1} [h_w(n - m_i) \times \bar{h}_w(n - m_j)], \quad (8)$$

and $$\phi_{xh}(m_k) = \phi_{hx}(-m_k) = \sum_{n=0}^{N-1} [x_w(n)h_w(n = m_k)], \quad (9)$$

for sampling instants $m_i$ and $m_j$ or $m_k$ between the zeroth and the (N−1)-th sampling instants, both inclusive.

According to the elder patent application, the amplitude $g_k$ of the k-th excitation pulse is regarded as a function of only the location $m_k$ of the k-th excitation pulse in Equations (7). In other words, the location $m_k$ is decided so as to maximize the absolute value $|g_k|$. The amplitude $g_k$ is determined by the maximum of the absolute values. It is therefore convenient to rewrite Equations (7) into:

$$\left.\begin{array}{l} g_1 = \phi_{xh}(m_1)/\phi_{hh}(m_1, m_1) \\ \text{and, for the second and subsequent excitation pulses:} \\ g_k = \left[\phi_{xh}(m_k) - \sum_{i=1}^{k-1} g_i\phi_{hh}(m_i, m_k)\right] \div \phi_{hh}(m_k, m_k). \end{array}\right\} \quad (10)$$

Referring to FIG. 2, a low bit-rate speech coding device according to a first embodiment of this invention is similar in structure to the system revealed in the elder patent application. The parts corresponding to those illustrated above in conjunction with FIG. 1 will be designated by like reference numerals.

The device has a coder input terminal 17 supplied with a discrete speech signal sequence x(n) of the type thus far described. A buffer memory 18 is for storing each segment of the discrete speech signal sequence x(n). Responsive to the segment, a K parameter calculator 19 calculates a sequence of K parameters $K_m$ representative of the spectral envelope of the segment as before. It is possible to calculate the K parameter sequence $K_m$ in the manner described in an article which is contributed by J. Makhoul to Proc. IEEE, April 1975, pages 561 to 580, under the title of "Linear Prediction: A Tutorial Review".

The K parameter sequence $K_m$ is coded by a first or K parameter coder 26 with a predetermined number of quantization bits into a parameter code sequence $I_m$. The coder 26 may be the circuitry described in an article contributed by R. Viswanathan et al to IEEE Transactions on Acoustics, Speech, and Signal Processing, June 1975, pages 309 to 321, under the title of "Quantization Properties of Transmission Parameters in Linear Predictive Systems".

The first coder 26 decodes the parameter code sequence $I_m$ into a sequence of decoded parameters $K_m'$ which correspond to the respective K parameters $K_m$. Responsive to the decoded parameter sequence $K_m'$, a weighting circuit 27 calculates a weighted segment $x_w(n)$ of the type described above. The weighting circuit 27 is similar to the weighting circuit 23 (FIG. 1) except that the weights w(n) are given to the setment x(n) rather than to the error e(n).

The decoded parameters $K_m'$ are fed also to an impulse response calculator 28 for use in calculating a sequence of impulse responses h(n) which a synthesizing filter has for the segment. As described in the elder patent application, the synthesizing filter is similar to the linear prediction coding synthesizer 16 (FIG. 1) and will later be described for completeness of the disclosure. It is preferred that the impulse response calculator 28 is for calculating a sequence of weighted response sequence $h_w(n)$.

Turning to FIG. 3 for a short while, the impulse response calculator 28 for producing the weighted response sequence $h_w(n)$ is in effect a cascade connection of the synthesizing filter and a weighting circuit for the synthesizing filter as described in the elder patent application. The synthesizing filter of the cascade connection, however, does not actually produce the synthesized samples of the kind described before in connection with FIG. 1.

In FIG. 3, the impulse response calculator 28 comprises a unit impulse response generator 31 for generating a unit impulse response. Supplied with the decoded parameter sequence $K_m'$, a parameter calculator 32 calculates at first a sequence of prediction parameters $a_m$ (m being from 1 up to M as described in conjunction with FIG. 1) which the synthesizing filter has for the decoded parameters $K_m'$. Supplied also with the constant r described heretobefore, the parameter calculator 32 produces a sequence of weighted parameters $b_m$ according to:

$$b_m = a_m r^m.$$

The unit impulse response is delivered to an adder 33, which produces a sum signal as will presently become clear. The sum signal is fed to a coefficient weighting circuit 34 through a delay circuit 35 for giving the sum signal a delay which is equal to a sampling interval, namely, the inverse of the sampling frequency. The parameter weighting circuit 34 is supplied moreover with the weighted parameter sequence $b_m$ and delivers its output signal to the adder 33. When denoted as the z-transform by $H_w(z)$, the transfer function of a combination of the adder 33, the parameter weighting circuit 34, and the delay circuit 35 is given by:

$$H_w(z) = 1/\left(1 - \sum_{m=1}^{M} a_m r^m z^{-m}\right),$$

the inverse z-transform of which is equal to the weighted response sequence $h_w(n)$. The sum signal therefore gives the weighted response sequence $h_w(n)$.

Turning back to FIG. 2, the weighted response sequence $h_w(n)$ is delivered to an autocorrelator 36 for use in calculating an autocorrelation or covariance function or coefficient $\phi_{hh}(m_i, m_j)$ of the weighted response sequence $h_w(n)$ in compliance with Equation (8). On the righthand side of Equation (8), a pair of arguments $(n-m_i)$ and $(n-m_j)$ represents each of various pairs of the sampling instants 0 through (N−1).

Turning to FIG. 4, the autocorrelator 36 may be what is described in the elder patent application. The autocorrelator 36 may comprise an input memory 41 having addresses for storing the weighted responses $h_w(n)$. An address generator 42 is for supplying the input memory 41 with an address signal which is scheduled to specify a pair of addresses at one time. Responsive to the address signal, the input memory 41 produces a pair of weighted responses $h_w(n-m_i)$ and $h_w(n-m_j)$. A multiplier 43 is for calculating a product $[h_w(n-m_i)h_w(n-m_j)]$. An adder 44 is for successively calculating the summation given on the righthand side of Equation (8). A switch 45, depicted as a mechanical switch merely for convenience of illustration, is timed for closure to successively provide autocorrelation coefficients $\phi_{hh}(m_i, m_j)$ for various pairs of the sampling instants $(n-m_i)$ and $(n-m_j)$. The autocorrelation coefficients are stored in an output memory 46 and produced therefrom as the autocorrelation function $\phi_{hh}(m_i, m_j)$.

Figure 5:
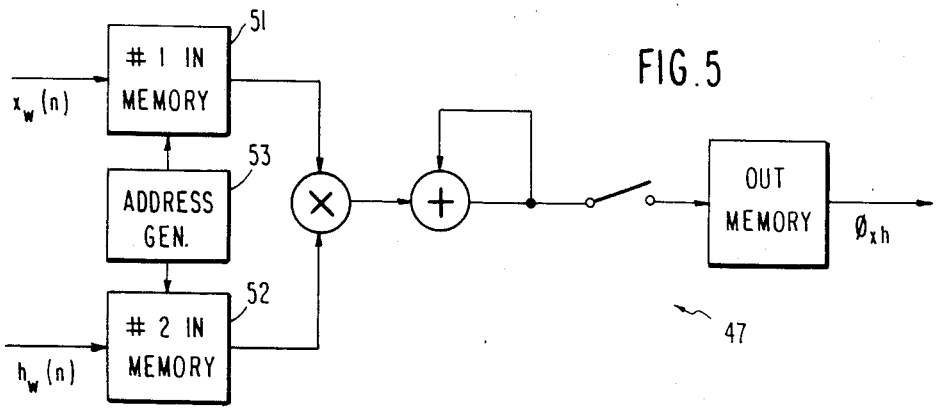
FIG. 5 is a block diagram of a cross-correlator for use in the device shown in FIG. 2.

Referring to FIG. 2 again and to FIG. 5 afresh, the weighted segment $x_w(n)$ and the weighted response sequence $h_w(n)$ are delivered to a cross-correlator 47 for use in calculating a cross-correlation function or coefficient $\phi_{xh}(m_k)$ therebetween in accordance with Equation (9). As described in the elder patent application, the crosscorrelator 47 may comprise first and second input memories 51 and 52. Like the input memory 41 (FIG. 4), each of the memories 51 and 52 has addresses for storing elements of the weighted segment x(n) and the weighted responses $h_w(n)$ therein. An address generator 53 is for delivering first and second address signals to the first and the second input memories 51 and 52, respectively. For each sampling instant $m_k$, the first and the second address signals are scheduled to make the first and the second input memories 51 and 52 produce the weighted segment elements $x_w(n)$ and the weighted responses $h_w(n-m_k)$. The cross-correlator 47 is similar in structure to the autocorrelator 36 in other respects and will no longer be described in detail.

In FIG. 2, the autocorrelation and the cross-correlation functions $\phi_{hh}(m_i, m_j)$ and $\phi_{xh}(m_k)$ are delivered to an excitation pulse sequence producing circuit 56 which corresponds to the excitation pulse sequence generating circuit 21 (FIG. 1). The excitation pulse sequence producing circuit 56 is, however, quite different in operation from the generating circuit 21 and is for producing a sequence of excitation pulses d(n) in response to the autocorrelation and the cross-correlation functions by successively deciding locations $m_k$ and amplitudes $g_k$ of the excitation pulses as will later be described in detail.

A second or excitation pulse location and amplitude coder 57 is for coding the excitation pulse sequence d(n) to produce an excitation pulse code sequence. Inasmuch as the excitation pulse sequence d(n) is given by the locations $m_k$ and the amplitudes $g_k$ of the excitation pulses, the second coder 57 codes the locations and the amplitudes. On so doing, it is possible to resort to known methods. For example, the locations $m_k$ are coded by the run length encoding known in the art of facsimile signal transmission. More particularly, the locations $m_k$ are coded by representing a "run length" between two adjacent excitation pulses by a code dependent on the "run length". The amplitudes $g_k$ may be coded by a conventional quantizer. The amplitudes may be normalized into normalized values by using, for example, a root mean square value of the maximum ones of the amplitudes in the respective segments as a normalizing coefficient. On quantizing, the normalizing coefficient may logarithmically be compressed. Alternatively, the amplitudes may be coded by a method described by J. Max in IRE Transactions on Information Theory, March 1960, pages 7 to 12, under the title of "Quantizing for Minimum Distortion".

A multiplexer 58 multiplexes the parameter code sequence $I_k$ delivered from the first coder 26 and the excitation pulse code sequence sent from the second coder 57. An output code sequence produced by the multiplexer 58 is supplied to, for example, a transmission channel (not shown) through a coder output terminal 59.

Referring to FIG. 6, a decoder is for use in combination with the low bit-rate speech coding device illustrated with reference to FIG. 2. The decoder has a decoder input terminal 61 for receiving the output code sequence of the coding device as an input code sequence A demultiplexer 62 demultiplexes the input code sequence into a first and a second decoder sequence. The first decoder sequence corresponds to the parameter code sequence $I_m$ and is delivered to a K parameter decoder 63. The second decoder sequence corresponds to the excitation pulse code sequence representative of the locations $m_k$ and the amplitudes $g_k$ of the excitation pulses in each segment and is fed to a pulse location and amplitude decoder 64 as depicted by two thin lines with arrowheads.

As described in the elder patent application, the K parameter decoder 63 may comprise a read-only memory (not shown) having addresses in which various values of the K parameters $K_m$ are preliminarily stored. An address generator (not shown) is for accessing the read-only memory by the first decoder sequence to make the read-only memory produce those of the K parameters as decoded K parameters $I_m'$ which correspond to the first decoder sequence. The decoded K parameters are stored in an output memory (not shown) as in the autocorrelator 36 illustrated with reference to FIG. 4. It is possible similarly implement the pulse location and amplitude decoder 64 and make the same produce decoded locations $m_k'$ and decoded amplitudes $g_k'$ as a collective sequence of decoded pulses.

Responsive to the decoded locations and amplitudes $m_k'$ and $g_k'$, an excitation pulse regenerator 65 regenerates the excitation pulse sequence as a reproduction d'(n). Although not shown, the regenerator 65 may comprise a pulse generator to which the decoded locations and amplitudes are fed through a distributor as described in the elder patent application. The reproduction may be stored in an output memory. Supplied with the decoded K parameter sequence $I_m'$ and the excitation pulse sequence reproduction d'(n), a synthesizing filter 66 first calculates prediction parameters $a_m'$ (not shown) and then produces a sequence of synthesized samples $\tilde{x}'(n)$. An output memory 67 is for storing the synthesized samples and deliveres the synthesized sample sequence $\tilde{x}'(n)$ to a decoder output terminal 68 as a reproduction of the discrete speech signal sequence x(n) supplied to the coder input terminal 17 (FIG. 2). As described in the elder patent application, the synthesizing filter 66 may be of the type described in Chapters 1 and 5 of a book "Linear Prediction of Speech" written by J. D. Markel et al and published 1976 by Springer Verlag.

Referring to FIGS. 7 and 8 (A) through (D), an example of the pulse sequence producing circuit 56 (FIG. 7) will be described along the line taught in the elder patent application. The circuit 56 may comprise a first memory 71 having addresses for storing the autocorrelation function $\phi_{hh}(m_i, m_j)$ and a second memory 72 having addresses for storing at first the cross-correlation function $\phi_{xh}(m_k)$. An address generator 73 produces first and second address signals for accessing the first and the second memories 71 and 72 to make them successively produce the autocorrelation and the cross-correlation functions for use in calculating the right-hand side of Equations (10).

It will now be assumed that the first through the (k−1)-th excitation pulses are previously processed pulses and that the k-th excitation pulse is a currently processed pulse. In other words, the amplitudes $g_1$ to $g_{k-1}$ and the locations $m_1$ to $m_{k-1}$ are already determined by an absolute value maximizer 74 as will presently become clear. The first memory 71 sends, among others, the autocorrelation coefficients $\phi_{hh}(m_k, m_k)$ to a reciprocal calculator 75 for use as the demonimator or divisor in the righthand side of Equations (10). The reciprocals are delivered to a first multiplier 76. The first memory 71 furthermore sends the autocorrelation coefficients $\phi_{hh}(m_{k-1}, m_k)$ to a second multiplier 77, to which the amplitude $g_{k-1}$ is supplied from the maximizer 74. The second multiplier 77 calculates the last or (k−1)-th term in the summation. It is convenient that the first term in the numerator or dividend and the summation for the first through the (k−2)-th excitation pulses be stored in a memory. The storage is carried out by using the second memory 72, a subtractor 78, and a second memory updating path 79. The calculation is continued until the K-th excitation pulse is processed.

On processing a first excitation pulse in a segment, the amplitude $g_1$ should be decided by:

$$g_1=\phi_{xh}(m_1)\phi_{hh}(m_1,m_1), \tag{11}$$

which equation is already given as a first one of Equations (10). At this moment, the second memory 72 supplies the subtractor 78 with the cross-correlation coefficients $\phi_{xh}(m_1)$ as minuends where $m_1$ represents the zeroth through the (N−1)-th sampling instants as exemplified in FIG. 8 (A). The maximizer 74 finds the maximum of the absolute values or squares of the amplitudes calculated by Equation (11). The maximum gives the amplitude $g_1$. The argument $m_1$ for which the maximum is found, gives the amplitude $m_1$. The first excitation pulse is found as illustrated in FIG. 8 (B).

On processing a second excitation pulse, the amplitude $g_2$ should be determined by:

$$g_2=[\phi_{xh}(m_2)-g_1\phi_{hh}(m_1,m_1)]\div\phi_{hh}(m_2,m_2), \tag{12}$$

where the amplitude $g_1$ and the location $m_1$ are already known. The second memory 72 delivers the cross-correlation coefficients $\phi_{xh}(m_2)$ to the subtractor 78 as minuends. The subtractor 78 calculates the numerator or dividend on the righthand side of Equation (12) and renews the second memory 72 through the updating path 79 as exemplified in FIG. 8 (C). In the meantime, the maximizer 74 gives the amplitude $g_2$ and the location $m_2$. The first and the second excitation pulses are found as shown in FIG. 8 (D).

Figure 9:
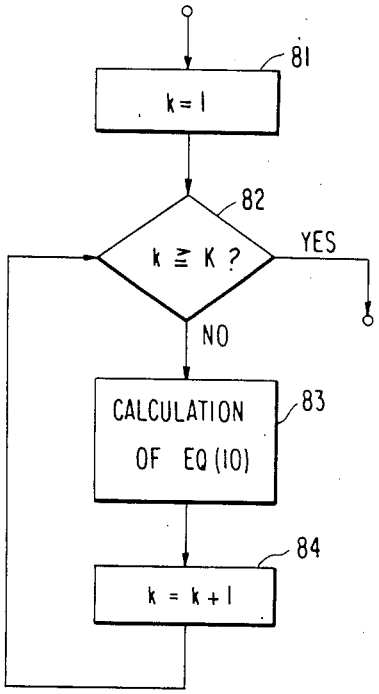
FIG. 9 PRIOR ART
FIG. 9 is a flow chart for use in describing operation of the circuit shown in FIG. 7.

Turning to FIG. 9, decision of the locations and the amplitudes of excitation pulses is carried out according to the elder patent application by initializing a count in a counter (not shown) to 1 at a first step 81. The count, represented by k, is compared at a second step 82 with the predetermined positive integer K. If the count reaches the integer K, the process comes to an end for a segment being processed. If not, Equations (10) are calculated at a third step 83 as described above with reference to FIGS. 7 and 8 (A) to (D). One is added to the count at a fourth step 84.

Referring back to FIG. 2, the excitation pulse sequence producing circuit 56 successively gives the first through the k-th excitation pulses by the use of a novel algorithm which will be described in the following. As will become clear as the description proceeds, it is possible for the novel algorithm to implement the excitation pulse sequence producing circuit 56 by a microprocessor.

As described heretobefore, let the k-th excitation pulse be the currently processed pulse with the first through the (k−1)-th excitation pulses dealt with already as the previously processed pulses. The error power J which results when the k-th pulse is added in the excitation pulse sequence d(n) to the first through the (k−1)-th pulses, will be named a k-th error power and denoted by $J_k$. The k-th error power $J_k$ is given by:

$$J_k = \sum_{n=0}^{N-1}\left[x_w(n) - \sum_{i=1}^{k} g_i h_w(n-m_i)\right]^2$$

which is not different in effect from Equation (6). It is therefore possible, by that one of Equations (7) or (10) which is for the k-th excitation pulse, to observe the effect caused on the k-th error power $J_k$ by addition of the k-th excitation pulse to the first through the (k−1)-th pulses.

In accordance with the novel algorithm, a pertinent can of Equations (10) is used in temporarily deciding the amplitude $g_k$ of the currently processed excitation pulse as a provisional amplitude and in deciding the location $m_k$ thereof. Those optimum amplitudes $g_i$ of the previously and the currently processed pulses which satisfy Equation (7) are given by the following linear symultaneous equations:

$$\begin{vmatrix} \phi_{hh}(m_1, m_1) \ldots \phi_{hh}(m_K, m_1) \\ \phi_{hh}(m_1, m_2) \ldots \phi_{hh}(m_K, m_2) \\ \cdot \quad \cdot \\ \cdot \\ \cdot \\ \phi_{hh}(m_1, m_K) \ldots \phi_{hh}(m_K, m_K) \end{vmatrix} \begin{vmatrix} g_1 \\ g_2 \\ \cdot \\ \cdot \\ \cdot \\ g_K \end{vmatrix} = \begin{vmatrix} \phi_{xh}(m_1) \\ \phi_{xh}(m_2) \\ \cdot \\ \cdot \\ \cdot \\ \phi_{xh}(m_K) \end{vmatrix} \tag{13}$$

Inasmuch as the first factor on the lefthand side of Equation (13) is a K-row K-column symmetric matrix with positive constants, the amplitudes $g_i$ are solved by a conventional high-speed algorithm, such as the algorithm according to the Cholesky decompotion. The algorithm of Cholesky will later be described. When the locations $m_1$ to $m_k$ and the amplitudes $g_1$ to $g_k$ are so decided, the k-th error power $J_k$ is given by:

$$J_k = \sum_{n=0}^{N-1}[x_w(n)]^2 - \sum_{i=1}^{k} g_i\phi_{xh}(m_i). \tag{14}$$

Figure 10:
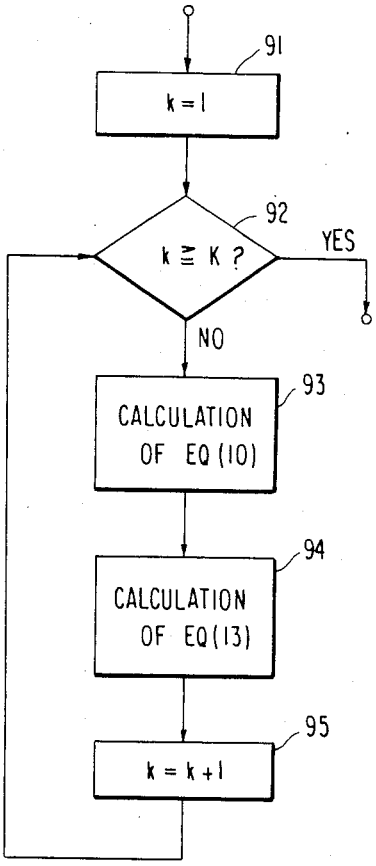
FIG. 10 is a flow chart for use in describing operation of an exciting pulse sequence producing circuit for use in the device illustrated in FIG. 2.

Referring now to FIG. 10, the suffix k is initialized at a first step 91 in order to decide the location $m_1$ and the amplitude $g_1$ of a first excitation pulse for a segment of the discrete speech signal sequence x(n). The suffix k is checked at a second step 92 whether or not the predetermined positive integer K is reached. The autocorrelation and the cross-correlation coefficients $\phi_{hh}(m_1, m_1)$ and $\phi(m_1)$ for the zeroth through the (N−1)-th sampling instants are used at a third step 93 in finding a maximum of the squares of the righthand side of the first one of Equations (10), namely, Equation (11). The location $m_1$ is given by that argument of the coefficients which maximizes the square. The amplitude $g_1$ is decided at a fourth step 94 by using the location $m_1$ in Equation (13).

For a second excitation pulse, the suffix k is increased by one at a fifth step 95. The location $m_2$ is decided at the third step 93 by the use of the location $m_1$ and the amplitude $g_1$ in Equation (12), namely, by using the coefficients $\phi_{hh}(m_1, m_2)$, $\phi_{hh}(m_2, m_2)$, and $\phi_{xh}(m_2)$ with the argument $m_2$ alone varied through the zeroth to the $(N-1)$-th sampling instants. Renewal of the amplitude $g_1$ of the previously processed excitation pulse to an optimum amplitude, is carried out simultaneously with calculation of the amplitude $g_2$ of the currently processed excitation pulse at the fourth step 94 by using the locations $m_1$ and $m_2$ of the previously and the currently processed pulses in Equation (13).

For a k-th excitation pulse, the location $m_k$ is decided at the third step 93 by using the locations $m_1$ through $m_{k-1}$ and the amplitudes $g_1$ through $g_{k-1}$ of the previously processed pulses in a pertinent one of Equations (10). Renewal of the amplitudes $g_1$ to $g_{k-1}$ of the previously processed pulses is carried out concurrently with decision of the amplitude $g_k$ of the currently processed pulse at the fourth step 94 with the use of the locations $m_1$ to $m_k$ of the previously and the currently processed pulses in Equation (13).

When the predetermined positive integer K is reached at the second step 92, the amplitudes $g_1$ to $g_K$ are no longer renewed. Processing comes to an end. Alternatively, it is possible to put an end to the processing before arrival at the integer K. For this purpose, the amplitude $g_k$ of a currently processed excitation pulse may be compared with a predetermined threshold value at the second step 92 as soon as the amplitude $g_k$ is decided at the fourth step 94 by Equation (13) concurrently with renewal of the amplitudes $g_1$ to $g_{k-1}$ of the previously processed excitation pulses. If the amplitude $g_k$ is smaller in absolute value than the threshold value, further processing is unnecessary. It is likewise possible to put an end to the processing when the k-th error power $J_k$ decreases below a preselected threshold value at the second step 92 with Equation (14) calculated immediately after the fourth step 94 by using the locations $m_1$ to $m_k$, the renewed amplitudes $g_1$ to $g_{k-1}$ of the previously processed pulses, and the amplitude $g_k$ of the currently processed pulse.

Before referring to FIG. 11, another noval algorithm will be described. The algorithm is for use in a low bit-rate speech coding device according to a second embodiment of this invention. The device comprises the parts illustrated with reference to FIG. 2. The difference from the device so far described, resides only in the algorithm used in the excitation pulse sequence producing circuit 56, which may again be implemented by a microprocessor. In accordance with the algorithm, the location $m_k$ of the currently processed excitation pulse is varied as will be described in the following, so as to minimize the k-th eror power $J_k$ of Equation (14) and thereby to decide the location $m_k$ in question and the amplitudes $g_i$ of the previously and the currently processed excitation pulses.

According to Cholesky, the first factor on the lefthand side of Equation (13) is decomposed so that Equation (13) is rewritten into:

$$\mathbb{V}\ \mathbb{D}\ \mathbb{V}^t\ \mathbb{g} = \mathbb{F}, \tag{15}$$

where $\mathbb{V}$ represents the lower triangular matrix with elements along the main diagonal rendered equal to unity, $\mathbb{D}$ represents the diagonal matrix, t indicates the transposition, $\mathbb{g}$ represents a column vector of the amplitudes $g_i$ of the first through the K-th excitation pulses, and $\mathbb{F}$ represents another column vector which stands on the righthand side of Equation (13). In other words:

$$\begin{vmatrix} \phi_{hh}(m_1, m_1) & \dots & \phi_{hh}(m_1, m_K) \\ \phi_{hh}(m_2, m_1) & \dots & \phi_{hh}(m_2, m_K) \\ \cdot & & \\ \cdot & & \\ \cdot & & \\ \phi_{hh}(m_K, m_1) & \dots & \phi_{hh}(m_K, m_K) \end{vmatrix} =$$

$$\begin{vmatrix} 1 & & & & \\ v_{21} & 1 & & 0 & \\ v_{31} & v_{32} & 1 & & \\ \cdot & & & & \\ \cdot & & & & \\ \cdot & & & & \\ v_{K1} & v_{K2} & v_{K3} & \dots & 1 \end{vmatrix} \begin{vmatrix} d_1 & & & & \\ & d_2 & & 0 & \\ & & d_3 & & \\ & & & \cdot & \\ & & & & \cdot \\ & 0 & & & \cdot \\ & & & & d_k \end{vmatrix} \begin{vmatrix} 1 & v_{21} & v_{31} & \dots & v_{K1} \\ & 1 & v_{32} & \dots & v_{K2} \\ & & 1 & \dots & v_{K3} \\ & & & \cdot & \\ 0 & & & \cdot & \\ & & & & \cdot \\ & & & & 1 \end{vmatrix}$$

where $v_{kj}$ and $d_k$ represent the elements of the lower triangular and the diagonal matrioes and are iteratively given by:

$$v_{kk} = 1, \tag{16}$$

$$v_{kj} = \left[ \phi_{hh}(m_k, m_j) - \sum_{i=1}^{j-1} v_{ki} d_i v_{ji} \right] / d_j, \tag{17}$$

for $2 \leqq j \leqq k-1$, $$d_1 = \phi_{hh}(m_1, m_1), \tag{18}$$

and $$d_k = \phi_{hh}(m_k, m_k) - \sum_{i=1}^{j-1} (v_{ki})^2 d_i, \tag{19}$$

for $2 \leqq j \leqq K$.

From Equation (15):

$$\mathbb{g} = \mathbb{V}\ \mathbb{D}^{-1}\ \mathbb{V} \tag{20}$$

where the third factor on the righthand side represents a column vector given by the product of the second and the following factors on the lefthand side of Equation (15). From Equation (14), the k-th error powers $J_k$ are given by:

$$J_k = \sum_{n=0}^{N-1} [x_w(n)]^2 - \mathbb{g}^t\ \mathbb{F}$$

Inasmuch as:

$$\mathbb{g}^t\ \mathbb{F} = \mathbb{Y}^t\ \mathbb{D}^{-1}\ \mathbb{Y}^t\ \mathbb{F} = \mathbb{Y}^t\ \mathbb{D}^{-1}\ \mathbb{Y}: \tag{21}$$

$$J_k = \sum_{n=0}^{N-1} [x_w(n)]^2 - \sum_{i=1}^{k} y_i^2/d_i,$$

where $y_i$ represents the elements of the column vector $\mathbb{Y}$. From the definition of the column vector $\mathbb{Y}$, the elements $y_i$ are iteratively given by:

$$y_1 = \phi_{xh}(m_1), \tag{22}$$

-continued and $$y_i = \phi_{xh}(m_i) - \sum_{j=1}^{j-1} v_{ij}y_j, \tag{23}$$

for $2 \leqq i \leqq K$.

The recurrence formulae (16) through (19), (22), and (23) are used in iteratively deciding the locations $m_k$ of the excitation pulses. More specifically, the locations $m_k$ are successively decided so as to minimize the k-th error powers $J_k$ of Equation (21), namely, so as to maximize the respective terms $y_i^2/d_i$ of the summation. For the first excitation pulse, the location $m_1$ is decided by the elements $d_1$ and $y_1$ of Equations (18) and (22) according to:

$$m_1 = \left\{ m \,|\, \max_m [\phi_{xh}(m)]^2/\phi_{hh}(m, m) \right\}, \tag{24}$$

where $0 \leqq m \leqq N - 1$.

As before, let the k-th excitation pulse be the currently processed pulse for the location $m_k$. At this moment, the locations $m_1$ through $m_{k-1}$ of the previously processed excitation pulses are already decided. In other words, the elements $v_{kj}$ of the lower triangular matrix are already calculated by Equation (17) to the $(k-1)$-th column. Also, the elements $d_1$ through $d_{k-1}$ are already calculated by Equation (19). Furthermore, the elements $y_1$ to $y_{k-1}$ are already calculated by Equation (23). Under the circumstances, the element $v_{kj}$ is a function of the location $m_k$ alone. The location $m_k$ is therefore decided by:

$$m_k = \left\{ m \,|\, \max \left[ \left( \phi_{xh}(m) - \sum_{j=1}^{k-1} v_{kj}y_j \right)^2 \div \left( \phi_{hh}(m, m) - \sum_{j=1}^{k-1} v_{kj}^2 d_j \right) \right] \right\}, \tag{25}$$

for $0 \leqq m \leqq N - 1$, where:

$$v_{k1} = \phi_{hh}(m, m_1) \tag{26}$$

and $$v_{kj} = \left[ \phi_{hh}(m, m_j) - \sum_{i=1}^{j-1} v_{ki}d_i v_{ji} \right] / d_j, \tag{27}$$

When the locations $m_1$ through $m_k$ of all excitation pulses are decided by Equations (24) and (25), the elements of the matrices used on the righthand side of Equation (20) are all known. The amplitudes $g_k$ of the first through the k-th excitation pulses are therefore successively decided by:

$$g_k = y_k/d_k - \sum_{j=k+1}^{K} v_{jk}g_j, \tag{28}$$

for $1 \leqq k \leqq K - 1$.

The initial condition is:

$$g_K = y_K/d_K, \tag{29}$$

Figure 11:
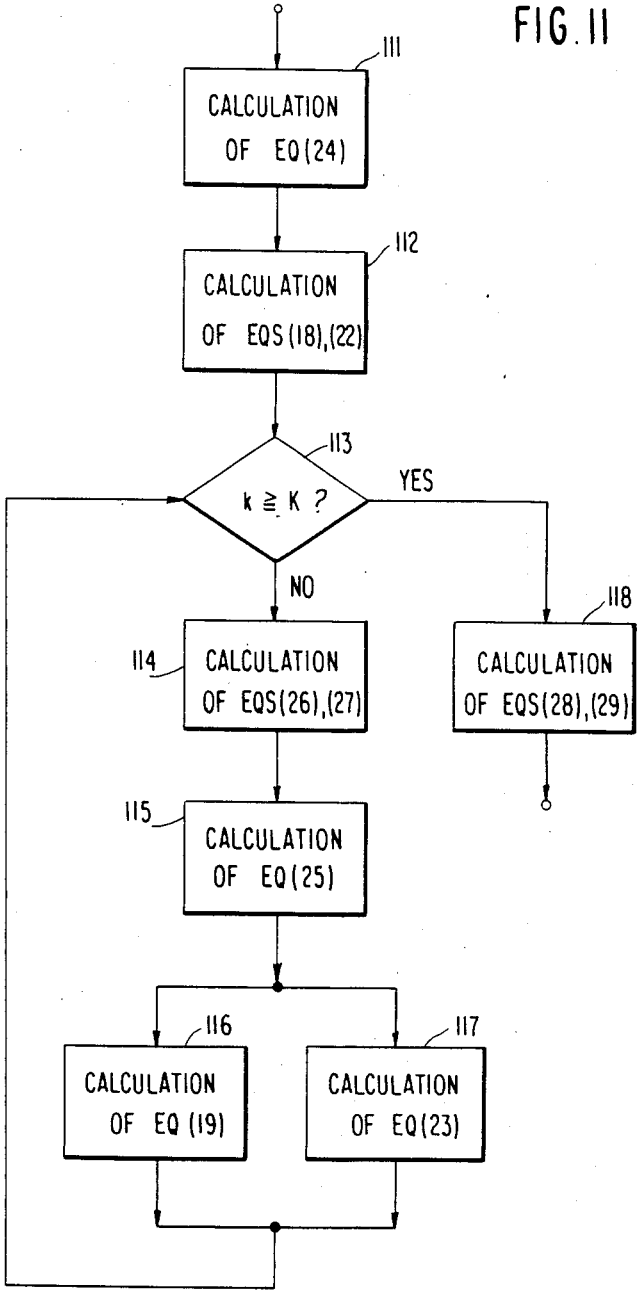
FIG. 11 is a flow chart for use in describing operation of an exciting pulse sequence producing circuit for use in a low bit-rate speech coding device according to a second embodiment of this invention.

In FIG. 11, Equation (24) is calculated at a first step 111 to decide the location $m_1$ of the first excitation pulse. The location $m_1$ is used at a second step 112 in calculating Equations (18) and (22) for the elements $d_1$ and $y_1$. The number k for the currently processed pulse as regards the location $m_k$ is checked at a third step 113 against the predetermined positive integer K. Before arrival at the integer K, Equations (26) and (27) are calculated at a fourth step 114 to give the elements $v_{kj}$ for $1 \leqq j \leqq k-1$. The elements $v_{kj}$ are used at a fifth step 115 in Equation (25) to decide the location $m_k$ of the currently processed pulse. The location $m_k$ is used at a sixth step 116 in Equation (19) to provide the element $d_k$. The location mk is furthermore used at a seventh step 117 in Equation (27) to provide the element $y_k$. The location is likewise decided at the fifth step 115 for the next excitation pulse. When the process is carried out to the K-th excitation pulse, the amplitudes $g_k$ of the first through the K-th excitation pulses are decided at an eight step 118 by using Equations (28) and (29). The algorithm comes to an end for a segment of the discrete speech signal sequence.

The algorithm described in conjunction with FIG. 10 will be reviewed. It should be understood that the location of the currently processed excitation pulse is decided by using the locations and the provisional amplitudes of the previously processed pulses in Equations (10) and that more optimum amplitudes of the previously processed pulses are decided together with the amplitude of the currently processed pulse by using the locations of the previously and the currently processed pulses and the provisional amplitudes of the previously processed pulses in Equation (13). The excitation pulse sequence is therefore more faithful when compared with that obtained by the elder patent application. With the autocorrelation and the cross-correlation functions preliminarily calculated for each segment, Equations (10) are calculated only by multiplication and subtraction processes. Furthermore, Equation (13) is calculable at a high speed because the first factor on the lefthand side is a symmetric matrix of positive elements as described before. The amount of calculation is therefore much reduced as compared with the analysis-by-synthesis method.

The algorhthm described in connection with FIG. 11 will next be reviewed. After the locations of the previously processed excitation pulses are decided, the location of the currently processed excitation pulse is decided by Equation (25). Subsequently, the amplitudes of the previously and the currently processed pulses are decided by Equation (13). The error power J is therefore remarkably reduced. In other words, the excitation pulse sequence is faithfully produced as compared with that provided by the elder patent application. The algorithm is given by linear recurrence formulae. The amount of calculation is therefore much reduced when compared with the analysis-by-synthesis method.

It is furthermore to be noted that the autocorrelation function exponentially decreases with the order and contributes only little to Equation (13). The elements $v_{kj}$ used in the recurrence formulae (17), (19), (23), (25), (27), and (28) can therefore be neglected when the absolute value of the difference between the sampling instants $m_k$ and $m_j$ is greater than a prescribed threshold value. The neglection corresponds to a reduction in the number of elements in Equation (13) and results in a further reduction in the amount of calculation.

In either event, it is possible to divide each frame of the discrete speech signal sequence into a preselected number P of subframes. This reduces the amount of calculation to 1/P. Either of the frame and the subframe is referred to hereinabove as a segment. The segment may have a variable segment length, which is effective in raising the performance of the low bit-rate speech coding device. The LSP parameters known in the art, may be substituted for the K parameters. Instead of the covariance function defined by Equation (8), it is possible to use the autocorrelation function defined by:

$$\phi_{hh}(m_i, m_j) = \sum_{n=0}^{N-|m_i-m_j|+1} h_w(n)h_w(n-|m_i-m_j|), \quad (30)$$

for $|m_i-m_j|$ between 0 and $(N-1)$, both inclusive. This further reduces the amount of calculation. The weighting factor w(n) may not be used in the equations thus far described. On calculating the autocorrelation or covariance function of the synthesizing filter, it is possible to use the inverse Fourier transform of the power spectrum of the synthesizing filter rather than to use Equation (8) or (30). Likewise, the corss-correlation function can be calculated by the inverse Fourier transform of a product of the power spectrum of the discrete speech signal sequence x(n) and the power spectrum of the synthesizing filter rather than by Equation (9).

Computer simulation was carried out for actual speech signals produced from utterances of a male and a female for short sentences in the Japanese language. The sampling frequency was 8 kHz and the segment length, 20 milliseconds. The orders of the synthesizing filter 66 and the pitch regeneration filter 63 were twelve and one, respectively. Improvements of 2.9 dB and 2.0 dB were achieved in the signal-to-noise ratio when the numbers of excitation pulses for each segment were eight and sixteen, respectively.

What is claimed is:

1. A method of coding each segment of a discrete speech signal sequence into an output code sequence, comprising the steps of:

calculating a parameter sequence representative of a spectral envelope of said segment;

coding said parameter sequence into a parameter code sequence;

calculating an impulse response sequence of a synthesizing filter for said segment by using said parameter code sequence;

calculating an autocorrelation function of said impulse response sequence;

calculating a cross-correlation function between said segment and said impulse response sequence;

producing a sequence of excitation pulses by using said autocorrelation and said cross-correlation functions in recursively deciding locations and amplitudes of said excitation pulses with the location of a currently processed pulse of said excitation pulses decided by the use of the locations and the amplitudes of previously processed pulses of said excitation pulses and with renewal of the amplitudes of said previously processed pulses carried out concurrently with decision of the amplitude of said currently processed pulse by the use of the locations of said previously and said currently processed pulses;

coding said sequence of excitation pulses into an excitation pulse code sequence; and combining said parameter code and said excitation pulse code sequences into said output code sequence.

2. A method of coding each segment of a discrete speech signal sequence into an output code sequence, comprising the steps of:

calculating a parameter sequence representative of a spectral envelope of said segment;

coding said parameter sequence into a parameter code sequence;

calculating an impulse response sequence of a synthesizing filter for said segment by using said parameter code sequence;

weighting said impulse response sequence by weights dependent on said parameter sequence to produce a weighted response sequence;

weighting said segment by said weights to produce a weighted segment;

calculating an autocorrelation function of said weighted response sequence;

calculating a cross-correlation function between said weighted segment and said weighted response sequence;

producing a sequence of excitation pulses by using said autocorrelation and said cross-correlation functions in recursively deciding locations and amplitudes of said excitation pulses with the location of a currently processed pulse of said excitation pulses decided by the use of the locations and the amplitudes of previously processed pulses of said excitation pulses and with renewal of the amplitudes of said previously processed pulses carried out concurrently with decision of the amplitude of said currently processed pulse by the use of the locations of said previously and said currently processed pulses:

coding said sequence of excitation pulses into an excitation pulse code sequence; and combining said parameter code and said excitation pulse code sequences into said output code sequence.

3. A method of coding each segment of a discrete speech signal sequence into an output code sequence, comprising the steps of:

calculating a parameter sequence representative of a spectral envelope of said segment;

coding said parameter sequence into a parameter code sequence;

calculating an impulse response sequence of a synthesizing filter for said segment by using said parameter code sequence;

calculating an autocorrelation function of said impulse response sequence;

calculating a cross-correlation function between said segment and said impulse response sequence;

producing a sequence of excitation pulses by using said autocorrelation and said cross-correlation functions in recursively deciding locations and amplitudes of said excitation pulses with the location of a currently processed pulse of said excitation pulses and the amplitudes of previously processed pulses of said excitation pulses and of said currently processed pulse decided by the use of the locations of said previously processed pulses;

coding said sequence of excitation pulses into an excitation pulse code sequence; and combining said parameter code and said excitation pulse code sequences into said output code sequence.

4. A method of coding each segment of a discrete speech signal sequence into an output code sequence for use in exciting a synthesizing filter, comprising the steps of:

calculating a parameter sequence representative of a spectral envelope of said segment;

coding said parameter sequence into a parameter code sequence;

calculating an impulse response sequence of said synthesizing filter for said segment by using said parameter code sequence;

weighting said impulse response sequence by weights dependent on said parameter sequence to produce a weighted response sequence;

weighting said segment by said weights to produce a weighted segment;

producing a sequence of excitation pulses by using a autocorrelation and a cross-correlation functions in recursively deciding locations and amplitudes of said excitation pulses with the location of a currently processed pulse of said excitation pulses and the amplitudes of previously processed pulses of said excitation pulses and of said currently processed pulse decided by the use of the locations of said previously processed pulses;

coding said sequence of excitation pulses into an excitation pulse code sequence; and combining said parameter code and said excitation pulse code sequences into said output code sequence.

5. A device for coding each segment of a discrete speech signal sequence into an output code sequence, said device comprising:

means responsive to said segment for calculating a parameter sequence representative of a spectral envelope of said segment;

means for coding said parameter into a parameter code sequence;

means responsive to said parameter code sequence for calculating an impulse response sequence of a synthesizing filter for said segment;

means responsive to said impulse response sequence for calculating an autocorrelation function of said impulse response sequence;

means responsive to said segment and said impulse response sequence for calculating a cross-correlation function between said segment and said impulse response sequence;

means responsive to said autocorrelation and said cross-correlation functions for producing a sequence of excitation pulses by recursively deciding locations and amplitudes of said excitation pulses with the location of a currently processed pulse of said excitation pulses decided by the use of the locations and the amplitudes of previously processed pulses of said excitation pulses and with renewal of the amplitudes of said previously processed pulses carried out concurrently with decision of the amplitude of said currently processed pulse by the use of the locations of said previously and said currently processed pulses;

means for coding said sequence of excitation pulses into an excitation pulse code sequence; and means for combining said parameter code and said excitation pulse code sequences into said output code sequence.

6. A device for coding each segment of a discrete speech signal sequence into an output code sequence, said device comprising:

means responsive to said segment for calculating a parameter sequence representative of a spectral envelope of said segment;

means for coding said parameter sequence into a parameter code sequence;

means responsive to said parameter code sequence for weighting an impulse response sequence of a synthesizing filter by weights dependent on said parameter sequence to produce a weighted response sequence;

means responsive to said parameter sequence for weighting said segment by said weights to produce a weighted segment;

means responsive to said weighted response sequence for calculating an autocorrelation function of said weighted response sequence;

means responsive to said weighted segment and said weighed response sequence for calculating a cross-correlation function between said weighted segment and said weighted segment and said weighed response sequence;

means responsive to said autocorrelation and said cross-correlation functions for producing a sequence of excitation pulses recursively deciding locations and amplitudes of said excitation pulses with the location of a currently processed pulse of said excitation pulses decided by the use of the locations and the amplitudes of previously processed pulses of said excitation pulses and with renewal of the amplitudes of said previously processed pulses carried out concurrently with decision of the amplitude of said currently processed pulse by the use of the locations of said previously and said currently processed pulses;

means for coding said sequence of excitation pulses into an excitation pulse code sequence; and means for combining said parameter code and said excitation pulse code sequences into said output code sequence.

7. A device for coding each segment of a discrete speech signal sequence into an output code sequence, said device comprising:

means responsive to said segment for calculating a parameter sequence representative of a spectral envelope of said segment;

means for coding said parameter sequence into a parameter code sequence;

means responsive to said parameter code sequence for calculating an impulse response sequence of a synthesizing filter for said segment;

means responsive to said impulse response sequence for calculating an autocorrelation function of said impulse response sequence;

means responsive to said segment and said impulse response sequence for calculating a cross-correlation function between said segment and said impulse response sequence;

means responsive to said autocorrelation and said cross-correlation functions for producing a sequence of excitation pulses by successively deciding locations and amplitudes of said excitation pulses with the location of a currently processed pulse of said excitation pulses and the amplitudes of previously processed pulses of said excitation pulses and of said currently processed pulse decided by the use of the locations of said previously processed pulses;

means for coding said sequence of excitation pulses into an excitation pulse code sequence; and means for combining said parameter code and said excitation pulse code sequences into said output code sequence.

8. A device for coding each segment of a discrete speech signal sequence into an output code sequence, said device comprising:

means responsive to said segment for calculating a parameter sequence representative of a spectral envelope of said segment;

means for coding said parameter sequence into a parameter code sequence;

means responsive to said parameter code sequence for weighting an impulse response sequence of a synthesizing filter by weights dependent on said parameter sequence to produce a weighted response sequence;

means responsive to said parameter sequence for weighting said segment by said weights to produce a weighted segment;

means responsive to said weighted response sequence for calculating an autocorrelation function of said weighted response sequence;

means responsive to said weighted segment and said weighted response sequence for calculating a cross-correlation function between said weighted segment and said weighted response sequence;

means responsive to said autocorrelation and said cross-correlation functions for producing a sequence of excitation pulses by successively deciding locations and amplitudes of said excitation pulses with the location of a currently processed pulse of said excitation pulses and the amplitudes of previously processed pulses of said excitation pulses and of said currently processed pulse decided by the use of the locations of said previously processed pulses;

means for coding said sequence of excitation pulses into an excitation pulse code sequence; and means for combining said parameter code and said excitation pulse code sequences into said output code sequence.

* * * * *

UNITED STATES PATENT AND TRADEMARK OFFICE
CERTIFICATE OF CORRECTION

PATENT NO. : 4,669,120

DATED : May 26, 1987

INVENTOR(S) : ONO

It is certified that error appears in the above-identified patent and that said Letters Patent is hereby corrected as shown below:

| | | |
|---|---|---|
| ABSTRACT, | LINE 6 | Delete "parmeter" and insert --parameter--; |
| COLUMN 1, | LINE 34 | After first occurrence of "method" insert --.--; |
| COLUMN 4, | LINE 16 | Delete "m" and insert --m--; |
| COLUMN 5, | LINE 11 | Delete "constant r" and insert --constant r--; |
| COLUMN 5, | LINES 13 and 14 | Delete "constant r" and insert --constant r--; |
| COLUMN 5, | LINE 17 | Delete "constant r" and insert --constant r--; |
| COLUMN 5, | LINE 19 | Delete "constant r" and insert --constant r--; |
| COLUMN 6, | LINE 6 | After "and" delete "$X(\tilde{z})$" and insert --$\tilde{X}(z)$-- |
| COLUMN 6, | LINE 34 | Delete "$x(n)^*$" and insert --$x(n)^*$--; |
| COLUMN 6, | LINE 38 | Delete "$h(n)^*$" and insert --$h(n)^*$-- |
| COLUMN 6, | LINE 57 | Delete "k being" and insert --k being--; |

UNITED STATES PATENT AND TRADEMARK OFFICE

CERTIFICATE OF CORRECTION

PATENT NO. : 4,669,120

DATED : May 26, 1987

INVENTOR(S) : ONO

It is certified that error appears in the above-identified patent and that said Letters Patent is hereby corrected as shown below:

COLUMN 8, LINE 24 Delete "m being" and insert --m being--;

COLUMN 8, LINES 26 and 27 Delete "constant r" and insert --constant r--;

COLUMN 11, LINE 28, FORMULA 11, Delete "(m1)φ" and insert --$(m_1)/\varphi$--;

COLUMN 11, LINE 59 Delete "by k" and insert --by k--

COLUMN 12, LINE 56 Delete "suffix k" and insert --suffix k--;

COLUMN 12, LINE 59 Delete "suffix k" and insert --suffix k--;

COLUMN 12, LINE 63 Delete "φ(m1) and insert --$\varphi x n(m_1)$--;

COLUMN 13, LINE 3 Delete "suffix k" and insert --suffix k--;

COLUMN 16, LINE 6 Delete "number k" and insert --number k--;

UNITED STATES PATENT AND TRADEMARK OFFICE

CERTIFICATE OF CORRECTION

PATENT NO. : 4,669,120

DATED : May 26, 1987

INVENTOR(S) : ONO

It is certified that error appears in the above-identified patent and that said Letters Patent is hereby corrected as shown below:

COLUMN 16, LINE 15 Delete "mk" and insert --$m_k$--;

COLUMN 19, LINE 42 After "parameter" (first instance) insert --sequence--.

Signed and Sealed this

Thirty-first Day of January, 1989

*Attest:*

*Attesting Officer*

DONALD J. QUIGG

*Commissioner of Patents and Trademarks*